US010962264B2

(12) United States Patent
Kobayashi et al.

(10) Patent No.: US 10,962,264 B2
(45) Date of Patent: Mar. 30, 2021

(54) HEAT SOURCE UNIT FOR REFRIGERATION APPARATUS

(71) Applicant: DAIKIN INDUSTRIES, LTD., Osaka (JP)

(72) Inventors: Keiko Kobayashi, Osaka (JP); Ying Ying Ji, Osaka (JP)

(73) Assignee: DAIKIN INDUSTRIES, LTD., Osaka (JP)

( * ) Notice: Subject to any disclaimer, the term of this patent is extended or adjusted under 35 U.S.C. 154(b) by 78 days.

(21) Appl. No.: 16/233,234

(22) Filed: Dec. 27, 2018

(65) Prior Publication Data

US 2019/0203988 A1 Jul. 4, 2019

(30) Foreign Application Priority Data

Dec. 28, 2017 (JP) ..... JP2017-254913

(51) Int. Cl.
*F25B 41/00* (2021.01)
*F25B 41/04* (2006.01)
F25D 23/06 (2006.01)
(Continued)

(52) U.S. Cl.
CPC ..... *F25B 41/003* (2013.01); *F24F 13/20* (2013.01); *F25B 41/04* (2013.01); *F25D 23/062* (2013.01);
(Continued)

(58) Field of Classification Search
CPC ..... F25D 23/062; F25D 2323/0028; F25D 2201/30; F04B 39/0033; B60H 1/005; G10K 11/16; F24F 2013/242; F24F 1/0003; F24F 1/0059; F24F 1/06; F24F 1/32; F24F 1/60; F24F 1/40; F24F 1/12; F24F 13/24;
(Continued)

(56) References Cited

U.S. PATENT DOCUMENTS 10,480,799 B2 * 11/2019 Yanase ..... F24F 13/20
2005/0050914 A1 * 3/2005 Lee ..... F24F 1/30 62/498
2009/0044554 A1 * 2/2009 Takeichi ..... F24F 1/54 62/259.1
2012/0167608 A1 * 7/2012 Bae ..... F24F 1/08 62/296
2015/0128631 A1 * 5/2015 Oguri ..... F25D 23/003 62/259.2

FOREIGN PATENT DOCUMENTS

ES 2680485 T3 * 9/2018 ..... F24F 1/30
JP H02-70136 U 5/1990
(Continued)

*Primary Examiner* — Frantz F Jules
*Assistant Examiner* — Martha Tadesse
(74) *Attorney, Agent, or Firm* — Osha Bergman Watanabe & Burton LLP

(57) ABSTRACT

A heat source unit for a refrigeration apparatus includes: a refrigerant circuit including a shut-off valve, a compressor, a heat exchanger, and a first refrigerant pipe positioned between the shut-off valve and the compressor; a fan that sends air to the heat exchanger; a casing that includes a side panel and that accommodates the refrigerant circuit and the fan; and a partitioning panel that partitions an internal space of the casing into a first space on the side panel side where the compressor is disposed, and a second space where the fan is disposed. The fan blows the air that has passed through the heat exchanger out to a front-surface side of the casing. The compressor, the shut-off valve, and the side panel are disposed in the stated order as the compressor, the shut-off valve, and the side panel as seen in a front view.

7 Claims, 7 Drawing Sheets

(51) Int. Cl.
*F24F 13/20* (2006.01)
*F25B 1/10* (2006.01)

(52) U.S. Cl.
CPC ..... *F25B 1/10* (2013.01); *F25B 2400/05* (2013.01); *F25B 2500/01* (2013.01); *F25B 2500/12* (2013.01); *F25B 2500/17* (2013.01); *F25D 2201/30* (2013.01); *F25D 2323/0028* (2013.01)

(58) Field of Classification Search
CPC ..... F24F 1/30; F25B 41/003; F25B 41/04; F25B 2500/12; F25B 2500/17; F25B 2400/05
See application file for complete search history.

(56) References Cited

FOREIGN PATENT DOCUMENTS

| | | | | | |
|---|---|---|---|---|---|
| JP | 2008298344 | A | * | 12/2008 | |
| JP | 2009014248 | A | * | 1/2009 | |
| JP | 2010025459 | A | * | 2/2010 | |
| JP | 2013164248 | A | * | 8/2013 | |
| JP | 5732532 | B2 | * | 6/2015 | ..... F24F 1/24 |
| JP | 2016133273 | A | * | 7/2016 | |
| JP | 2017180946 | A | * | 10/2017 | |
| WO | WO-2007032275 | A1 | * | 3/2007 | ..... F25B 41/003 |
| WO | WO-2018225189 | A1 | * | 12/2018 | ..... F16L 59/147 |

* cited by examiner

HEAT SOURCE UNIT FOR REFRIGERATION APPARATUS

TECHNICAL FIELD

A heat source unit for a refrigeration apparatus

BACKGROUND

Refrigerant circuits having a shut-off valve, a compressor, and a heat exchanger are publicly known in the prior art. Patent Literature 1 (Japanese Unexamined Utility Model Publication No. 2-70136) discloses an outdoor unit for an air conditioner provided with a compressor and/or a refrigerant pipe connected to the compressor.

Size reduction is in demand for heat source units for refrigeration apparatuses, such as outdoor units for air conditioners.

However, when the casing of the heat source unit is reduced in size, there is a tendency for an internal space of the casing to also become smaller and for a gap between the compressor and the pipe to become smaller. In such cases, when, for example, a soundproof material is wrapped around the compressor, the work of doing so is difficult.

SUMMARY

One or more embodiments of the present disclosure improve the workability during manufacture or maintenance in a heat source unit for a refrigeration apparatus.

A heat source unit for a refrigeration apparatus according to one or more embodiments comprises a refrigerant circuit, a fan, a casing, and a partitioning panel. The refrigerant circuit has a shut-off valve, a compressor, a heat exchanger, and a first refrigerant pipe. The first refrigerant pipe is positioned between the shut-off valve and the compressor. The casing has the fan and a side panel. The casing accommodates the refrigerant circuit and the fan. The purpose of the fan is to send air to the heat exchanger. The partitioning panel partitions an internal space of the casing into a first space where the compressor is placed, and a second space where the fan is placed. Within the internal space of the casing partitioned by the partitioning panel, the first space is on the same side as the side panel. The fan blows the air passing through the heat exchanger out to a front-surface side of the casing. The compressor, the shut-off valve, and the side panel are placed in order as the compressor, the shut-off valve, and the side panel as seen in a front view. The first refrigerant pipe has a first part (first pipe), a first curved part (first curved pipe), and a second part (second pipe). The first part extends along the side panel. The first curved part extends from an end of the first part and curves so as to head to the side panel side. The second part extends toward the side panel from an end on the side opposite from the first part side of the first curved part.

In one or more embodiments, the gap between the compressor and the first refrigerant pipe widens due to the first refrigerant pipe having a shape such as is described above. The widening of this gap makes work such as wrapping soundproof material around the compressor easier. Specifically, with the heat source unit for a refrigeration apparatus of one or more embodiments, workability during manufacture or maintenance is improved.

In a heat source unit for a refrigeration apparatus according to one or more embodiments, the first refrigerant pipe further has a second curved part (second curved pipe) and a third part (third pipe). The second curved part extends from an end of the second part that is on the side opposite from the first curved part. The third part extends so as to not draw near the side panel from an end of the second part that is on the side opposite from the second part.

In one or more embodiments, because the first refrigerant pipe has the first curved part, the second part, and the second curved part, the third part can be separated from the compressor and brought nearer to the side panel.

In a heat source unit for a refrigeration apparatus according to one or more embodiments, the third part extends along the side panel, upward from the end of the second curved part.

In one or more embodiments, the first part and the third part both extend along the side panel. However, because the first refrigerant pipe has the first curved part, the second part, and the second curved part, the third part can be separated from the compressor and brought nearer to the side panel.

A heat source unit for a refrigeration apparatus according to one or more embodiments further comprises a soundproof material placed around the compressor. Part of the soundproof material is positioned between the compressor and the third part.

In one or more embodiments, part of the soundproof material is positioned between the compressor and the third part, but because the third part can be separated from the compressor and brought nearer to the side panel, it is easier to attach or remove the soundproof material during manufacture or maintenance of the heat source unit.

In a heat source unit for a refrigeration apparatus according to one or more embodiments, the first refrigerant pipe is further provided with a third curved part (third curved pipe) and a fourth part (fourth pipe). The third curved part extends from an end of the third part that is on the side opposite from the second curved part. The fourth part extends from an end of the third curved part that is on the side opposite from the third part, so as to separate from the side panel.

In a heat source unit for a refrigeration apparatus according to one or more embodiments, the first part extends from the shut-off valve, in a longitudinal direction along the side panel.

In one or more embodiments, even in a heat source unit configured such that the first part extends in the longitudinal direction from the shut-off valve, the third part can be separated from the compressor and placed in a position near the side panel by providing the first curved part and extending the second part toward the side panel.

In a heat source unit for a refrigeration apparatus according to one or more embodiments, the refrigerant circuit is further provided with a first refrigerant container. The first refrigerant container is positioned between the compressor and the first refrigerant pipe. As seen in a front view, the compressor, the first refrigerant container, the shut-off valve, and the side panel are placed in order as the compressor, the first refrigerant container, the shut-off valve, and the side panel.

In one or more embodiments, there is also a first refrigerant container between the compressor and the side panel. However, because the third part can be placed in a position separated from the compressor and near to the side panel, the gap between the first refrigerant container and the first refrigerant pipe widens, and workability during manufacture or maintenance is improved.

DETAILED DESCRIPTION (1) Overall configuration of air conditioning apparatus

Figure 1:
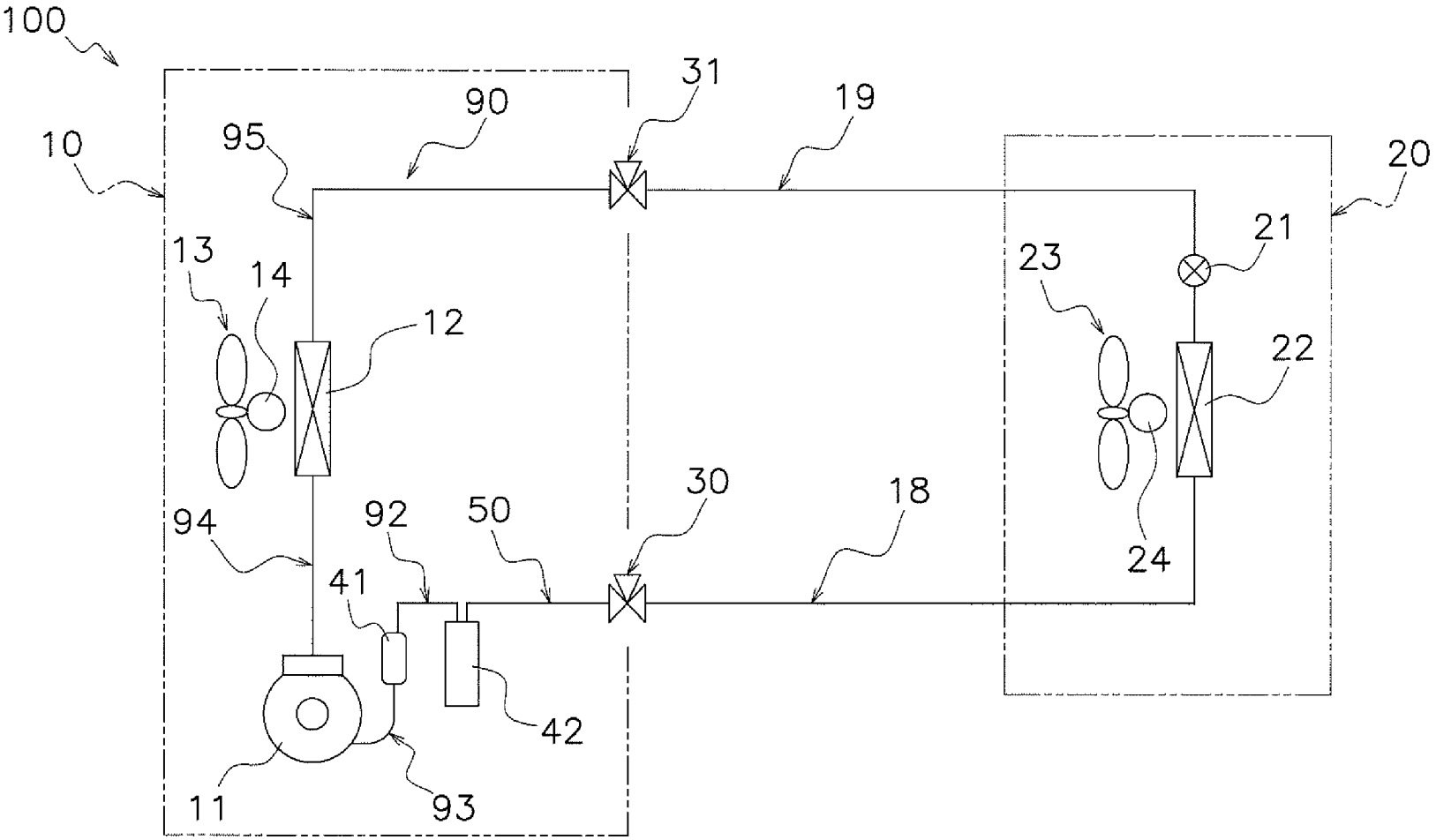
FIG. 1 is a diagram of a pipe system for an air conditioning apparatus according to one or more embodiments.

The overall configuration of an air conditioning apparatus 100, which is a refrigeration apparatus according to one or more embodiments, shall be described using FIG. 1. In FIG. 1, the overall configuration of the air conditioning apparatus 100 is represented by a pipe system diagram according to one or more embodiments.

Using a vapor-compression refrigeration cycle, the air conditioning apparatus 100 performs air-cooling of a room interior in a building or the like, as shown in FIG. 1. The air conditioning apparatus 100 is an air-cooling-only apparatus. The air conditioning apparatus 100 is provided with an outdoor unit 10, which serves as a heat source unit, and an indoor unit 20.

The outdoor unit 10 and the indoor unit 20 are connected by a gas refrigerant communication pipe 18 and a liquid refrigerant communication pipe 19.

(1-1) Outdoor Unit

The outdoor unit 10 according to one or more embodiments is provided to the outside of a building. A refrigerant circuit 90 of the outdoor unit 10 is connected to the indoor unit 20 via the gas refrigerant communication pipe 18 and the liquid refrigerant communication pipe 19.

The outdoor unit 10 is provided with a compressor 11, an outdoor heat exchanger 12, an outdoor fan 13, an outdoor fan electric motor 14, a gas-side shut-off valve 30, a liquid-side shut-off valve 31, a first accumulator 41 serving as a first refrigerant container, and a second accumulator 42.

The compressor 11 brings a refrigerant gas from a low pressure to a high pressure and expels the refrigerant gas. The first accumulator 41 and the second accumulator 42 are connected to an intake side of the compressor 11.

The outdoor heat exchanger 12 is connected to a discharge side of the compressor 11. The outdoor heat exchanger 12 causes air and the refrigerant to exchange heat, and condenses the refrigerant gas to a refrigerant liquid. The outdoor fan 13, driven by the outdoor fan electric motor 14, sends an air current to the outdoor heat exchanger 12.

The refrigerant circuit 90 of the outdoor unit 10 is composed of the compressor 11, the outdoor heat exchanger 12, the first accumulator 41, the second accumulator 42, and refrigerant pipes 50, 92-95 joining the aforementioned components together. The second accumulator 42 and the gas-side shut-off valve 30 are connected by a first refrigerant pipe 50. The gas-side shut-off valve 30 and the liquid-side shut-off valve 31 are manual valves.

(1-2) Indoor Unit

The indoor unit 20 according to one or more embodiments is provided inside a building. For example, numerous indoor units 20 are installed in a large space inside a factory.

The indoor unit 20 is provided with an electronic expansion valve 21, an indoor heat exchanger 22, an indoor fan 23 and an indoor fan electric motor 24.

The electronic expansion valve 21 causes the liquid refrigerant to expand to a gas-liquid mixed refrigerant. The indoor heat exchanger 22 causes air and the refrigerant to exchange heat, and causes the gas-liquid mixed refrigerant to evaporate to a refrigerant gas. The indoor fan 23, driven by an indoor fan electric motor 24, sends air to the indoor heat exchanger 22.

(2) Air-Cooling Operation

The actions during the air-cooling operation of the air conditioning apparatus 100 according to one or more embodiments shall be described using FIG. 1.

The high-temperature, high-pressure refrigerant gas compressed by the compressor 11 flows toward the outdoor heat exchanger 12. In the outdoor heat exchanger 12, the high-temperature, high-pressure refrigerant gas is depleted of heat by the air and condensed to a refrigerant liquid. The condensed refrigerant liquid flows toward the electronic expansion valve 21 via the liquid refrigerant communication pipe 19.

The refrigerant liquid is expanded to a gas-liquid mixed refrigerant by the electronic expansion valve 21. The gas-liquid mixed refrigerant flows toward the indoor heat exchanger 22 via the liquid refrigerant communication pipe 19. In the indoor heat exchanger 22, the gas-liquid mixed refrigerant is given heat by the air and evaporated to a refrigerant gas. The evaporated refrigerant gas is taken into the compressor 11 via the gas refrigerant communication pipe 18.

(3) Detailed Configuration of Outdoor Unit

The detailed configuration of the outdoor unit 10 according to one or more embodiments shall be described using FIGS. 2 to 7.

The description below is given according to the width direction, depth direction, and height direction shown in FIGS. 2 and 3, for ease in understanding. For the depth direction, the side to which the outdoor fan 13 blows out air is defined as the front side, and for the width direction, left and right in a front view of the outdoor unit 10 remain defined as the left side and right side.

The above-described components of the outdoor unit 10 are covered by a casing 80. This outdoor unit 10 has a form referred to as a trunk, in which air is taken in from back and left-side surfaces, and air is blown out to a front-surface side. The casing 80 is provided with a bottom panel 81, a top panel 82, a left-side panel 83, a right-side panel 84, a front panel 85, a rear panel 86, and a blowing grill 87. The front surface of the casing 80 is configured from the front panel 85 and the blowing grill 87. The back surface of the casing 80 is configured from the outdoor heat exchanger 12 and the rear panel 86.

The interior of the casing 80 is partitioned by a partitioning panel 88 into a first space S1 and a second space S2. The partitioning panel 88 is provided upright to the bottom panel 81.

Stored in the first space S1 are first through fifth refrigerant pipes 50, 92-95, the compressor 11, the outdoor heat exchanger 12, the first accumulator 41, the second accumulator 42, a first soundproof material 61, and a second soundproof material 62.

Three legs of the compressor 11 are fixed to the bottom panel 81 by damping rubber mounts 15. The first accumulator 41 is fixed to the compressor 11 by an attachment member 16. The second accumulator 42 is fixed to the bottom panel 81.

The first refrigerant pipe 50 connects the gas-side shut-off valve 30 and the second accumulator 42 together. The second refrigerant pipe 92 connects the second accumulator 42 and the first accumulator 41 together. The third refrigerant pipe 93 connects the first accumulator 41 and the intake side of the compressor 11 together. The fourth refrigerant pipe 94 connects the discharge side of the compressor 11 and the outdoor heat exchanger 12 together. The fifth refrigerant pipe 95 connects the outdoor heat exchanger 12 and the liquid-side shut-off valve 31 together.

Figure 7:
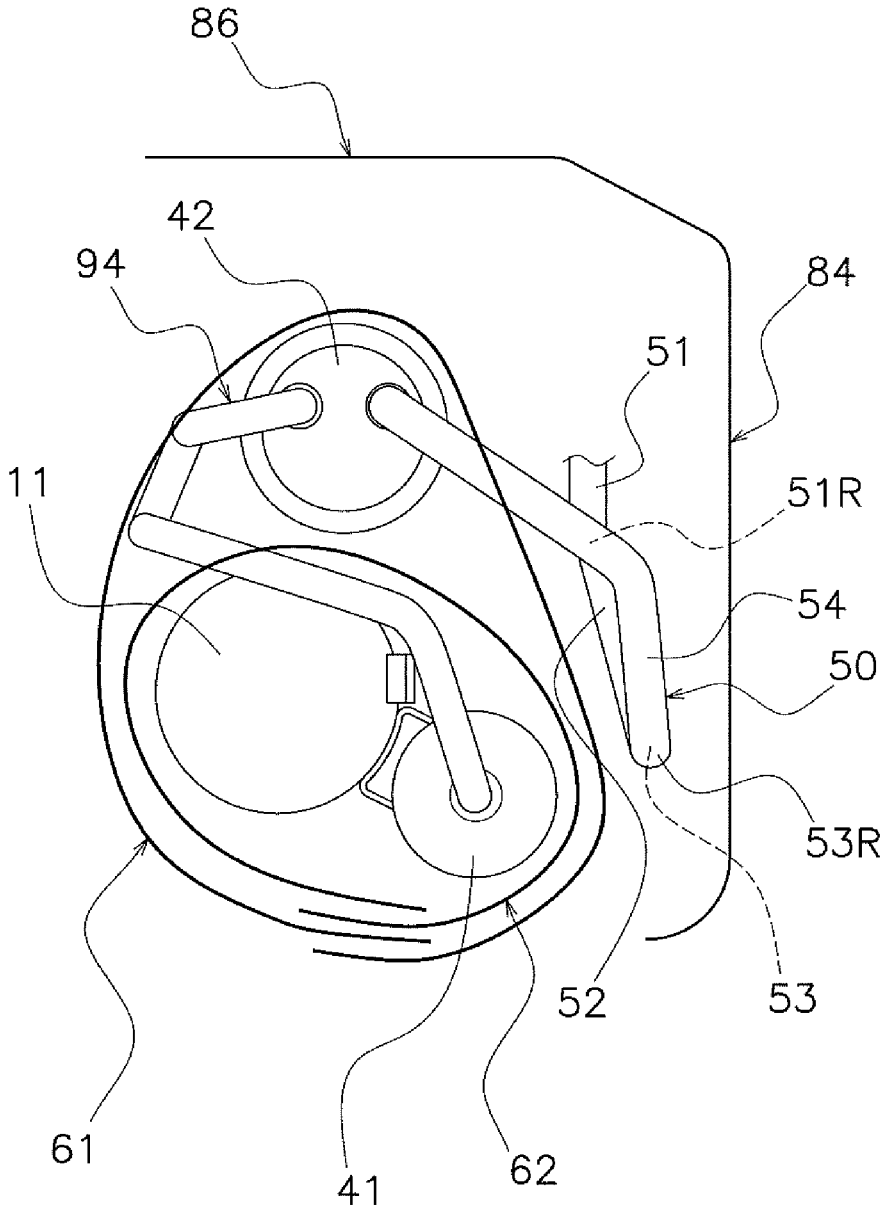
FIG. 7 is a conceptual diagram showing a state in which a soundproof material has been wrapped around a compressor and an accumulator according to one or more embodiments.

The first soundproof material 61 is wrapped around the compressor 11 and the first accumulator 41, according to one or more embodiments shown in FIG. 7. The compressor 11 and the first accumulator 41 wrapped in the first soundproof material 61, and the second accumulator 42 also, are wrapped in the second soundproof material 62. The first soundproof material 61 and the second soundproof material 62 are intended to suppress vibration and noise. The first soundproof material 61 and the second soundproof material 62 contain, for example, glass fiber and/or rubber.

The gas-side shut-off valve 30 and the liquid-side shut-off valve 31 are provided to an attachment panel 17. The attachment panel 17 is fixed to the bottom panel 81 or another component. The gas refrigerant communication pipe 18 is connected to the gas-side shut-off valve 30. The liquid refrigerant communication pipe 19 is connected to the liquid-side shut-off valve 31.

(3-1) First Refrigerant Paipe

Next, the configuration of the first refrigerant pipe 50 according to one or more embodiments shall be described in detail.

The first refrigerant pipe 50 has a first part 51, a first curved part 51R, a second part 52, a second curved part 52R, a third part 53, a third curved part 53R, and a fourth part 54. Gas refrigerant that has returned to the outdoor unit 10 from the indoor unit 20 via the gas refrigerant communication pipe 18 flows from the gas-side shut-off valve 30, through the first refrigerant pipe 50, to the second accumulator 42. The terms "upstream" and "downstream" are used in the following description of the components of the first refrigerant pipe 50; "upstream" means toward the side of the gas-side shut-off valve 30 is located, and "downstream" means toward the side of the second accumulator 42 (i.e., toward the side of the compressor 11).

The first part 51 extends in a longitudinal direction (depth direction) along the right-side panel 84, from an upstream end 51*a* connected to the gas-side shut-off valve 30.

The first curved part 51R extends from a downstream end 51b of the first part 51, and curves so as to lead toward the right-side panel 84.

The second part 52 extends toward the right-side panel 84 from a downstream end 51Rb of the first curved part 51R. The downstream end 51Rb of the first curved part 51R is the end on the side opposite from an upstream end 51Ra on the first part 51 side of the first curved part 51R.

The second curved part 52R extends from a downstream end 52*b* of the second part 52. The downstream end 52*b* of the second part 52 is the end on the side opposite from an upstream end 52*a* on the first curved part 51R side of the second part 52.

The third part 53 extends from a downstream end 52Rb of the second curved part 52R, so as to not draw nearer to the right-side panel 84. Specifically, the third part 53 extends upward along the right-side panel 84, from the downstream end 52Rb of the second curved part 52R. The downstream end 52Rb of the second curved part 52R is the end on the side opposite from an upstream end 52Ra on the second part 52 side of the second curved part 52R.

The third curved part 53R extends from a downstream end 53*b* of the third part 53. The downstream end 53*b* of the third part 53 is the end on the side opposite from an upstream end 53*a* on the second curved part 52R side of the third part 53.

The fourth part 54 extends from a downstream end 53Rb of the third curved part 53R, so as to draw away from the right-side panel 84. The downstream end 53Rb of the third curved part 53R is the end on the side opposite from an upstream end 53Ra on the third part 53 side of the third curved part 53R.

A downstream side of the fourth part 54 has two curved parts and/or straight parts. A downstream end of the first refrigerant pipe 50 is connected to the second accumulator 42.

The first part 51, the second part 52, the third part 53, and the fourth part 54 are straight portions, and the first curved part 51R, the second curved part 52R, and the third curved part 53R are curved portions in a copper pipe configuring the first refrigerant pipe 50.

Figure 2:
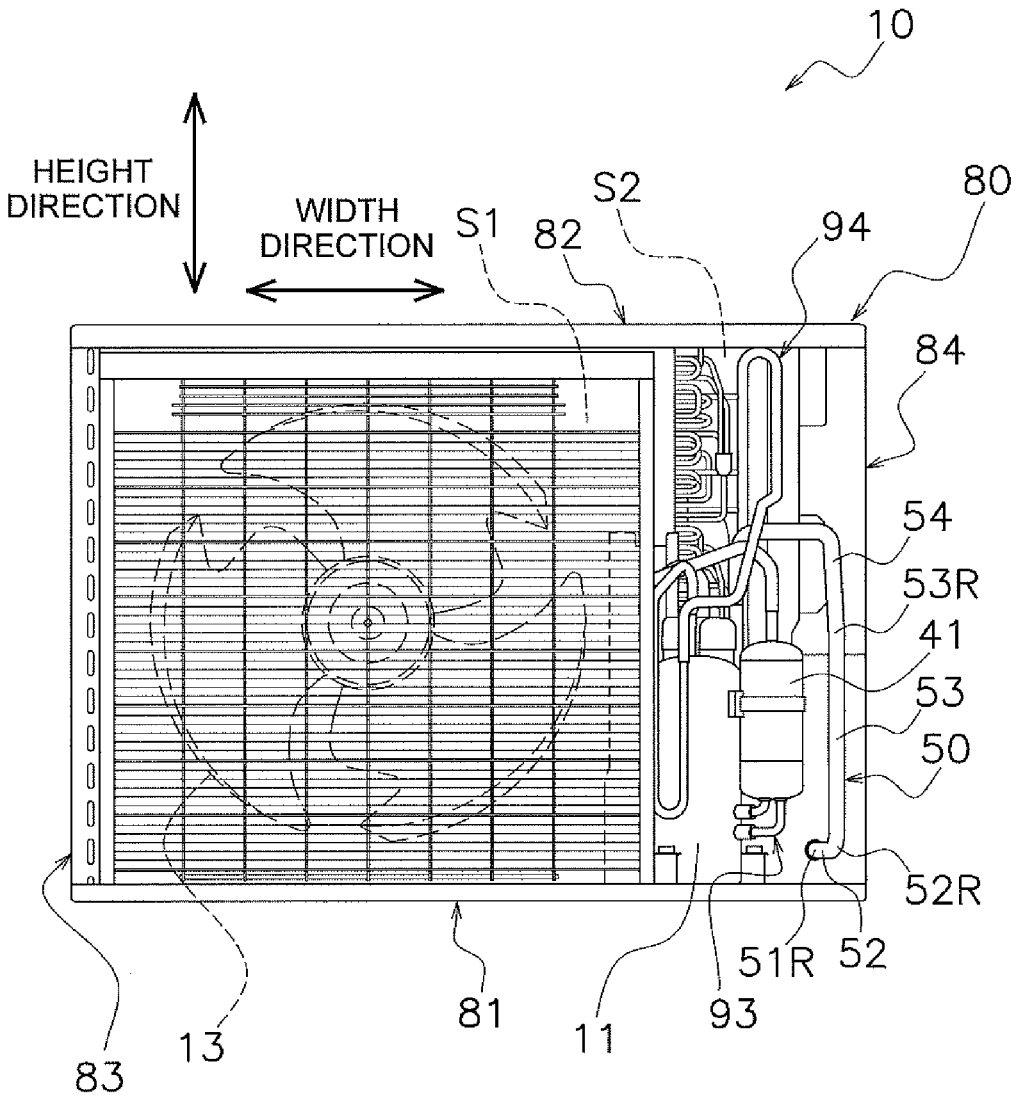
FIG. 2 is a front view of a heat source unit according to one or more embodiments.
Figure 4:
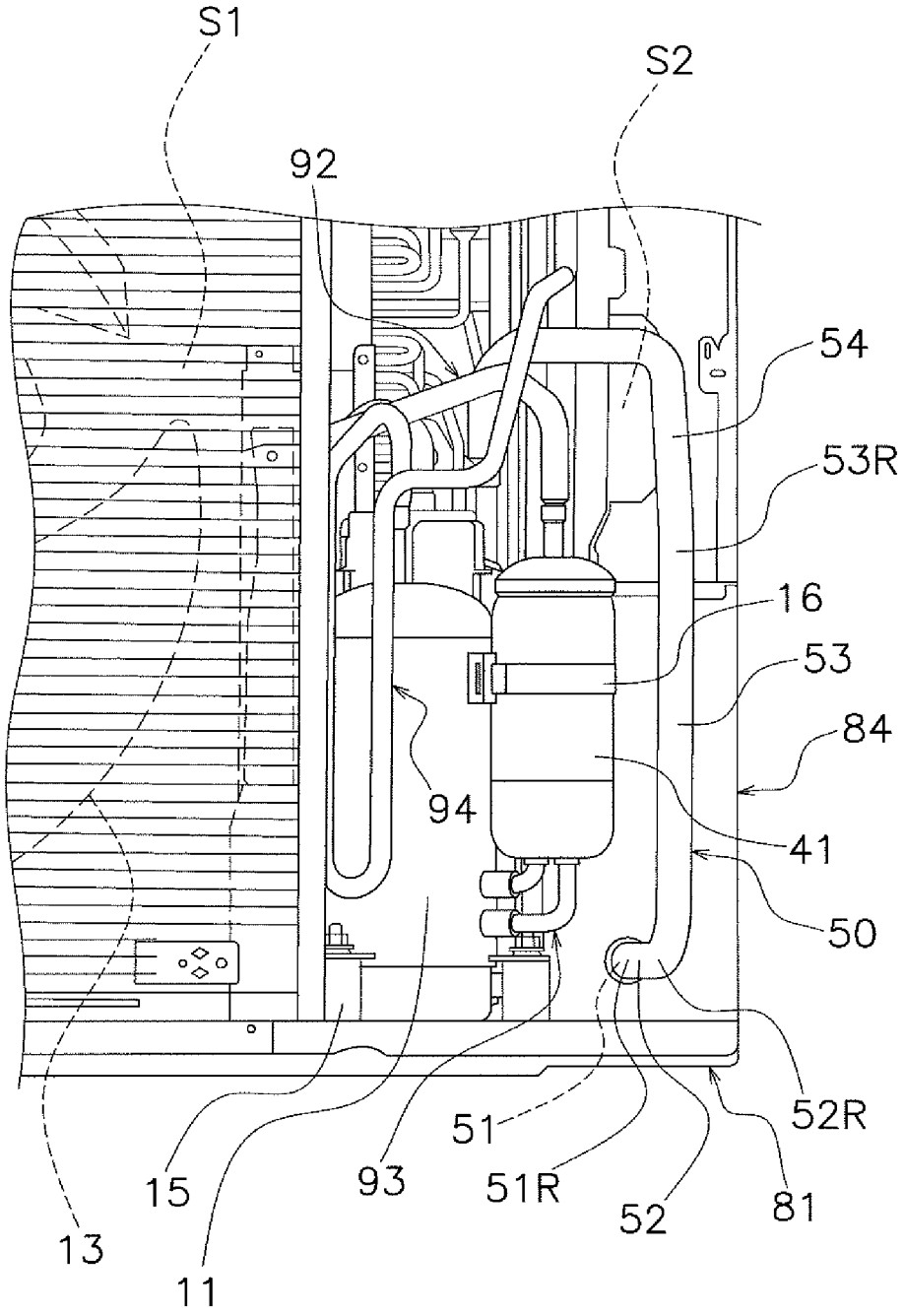
FIG. 4 is an enlarged front view of part of the heat source unit according to one or more embodiments.
Figure 5:
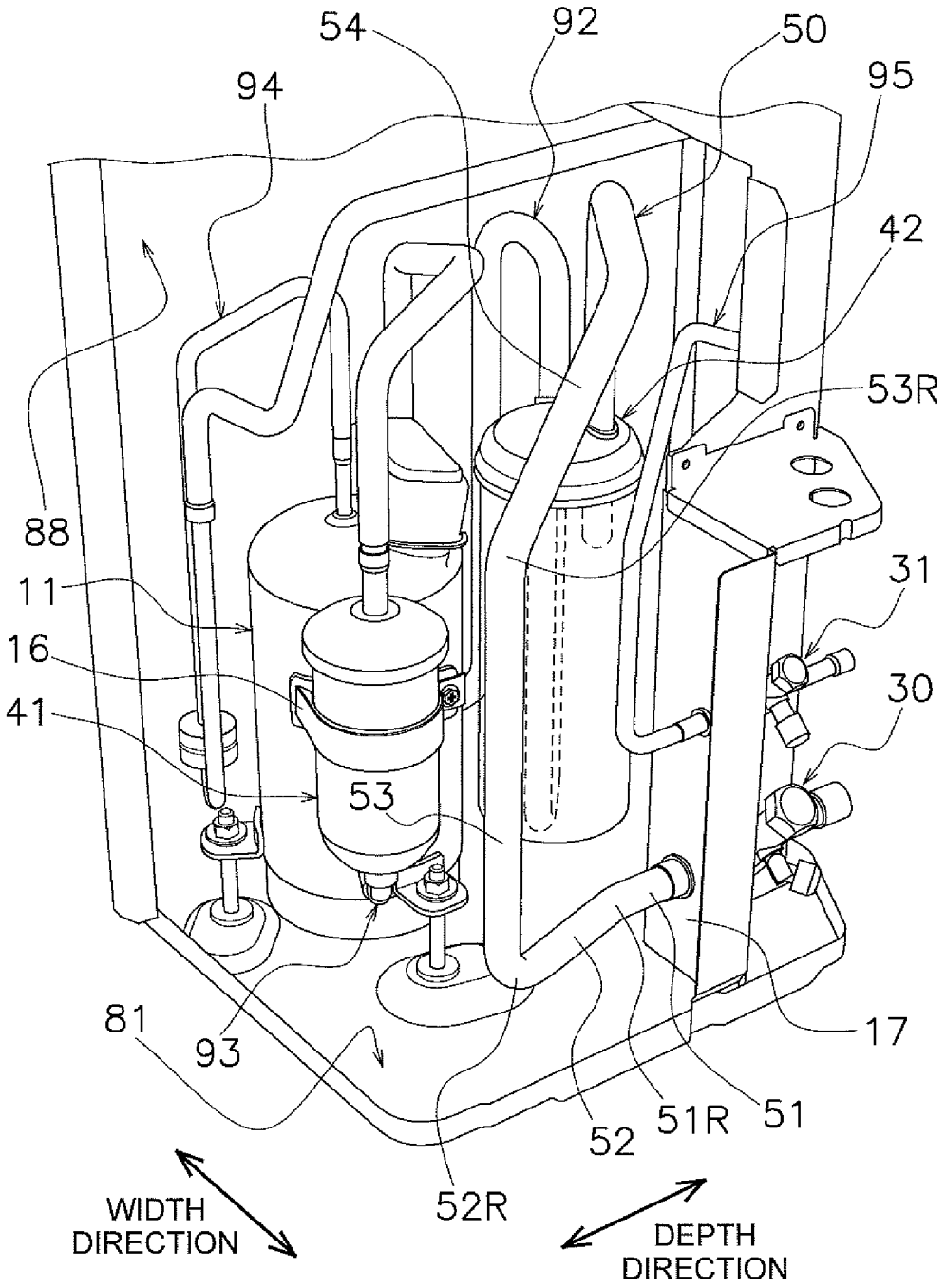
FIG. 5 is a perspective view showing the structure in the vicinity of a first refrigerant pipe of the heat source unit according to one or more embodiments.
Figure 6:
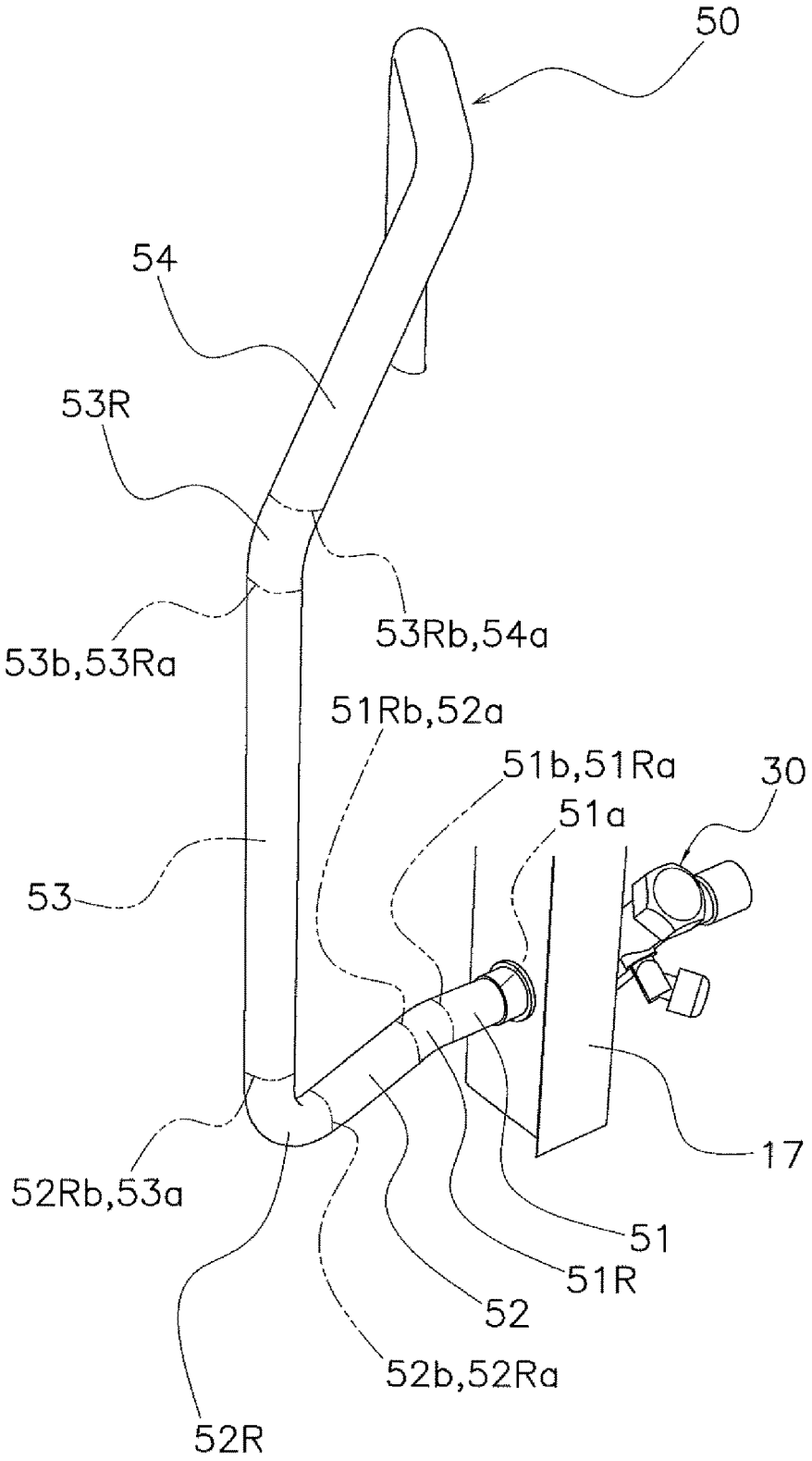
FIG. 6 is an enlarged perspective view of the first refrigerant pipe of the heat source unit according to one or more embodiments.

(3-2) Placement of Compressor, Gas-Side Shut-Off Valve, Right-Side Panel, Etc., in Front View According to one or more embodiments shown in FIGS. 2 and 4, in a front view, the compressor 11, the first accumulator 41, the second accumulator 42, the gas-side shut-off valve 30, and the right-side panel 84 are, in order from the left, placed in order as the compressor 11, the second accumulator 42, the first accumulator 41, the gas-side shut-off valve 30, and the right-side panel 84. The space between the compressor 11 and/or first accumulator 41 and the right-side panel 84 becomes smaller as the compressor 11 and other components are increased in size. Furthermore, a connection port of the gas-side shut-off valve 30 is slightly separated from the right-side panel 84 and is directed toward the front-surface side.

In such a component placement in the outdoor unit 10, the first refrigerant pipe 50 is designed so that the second part 52 leads to the right-side panel 84 due to the first curved part 51R, and the upwardly extending third part 53 separates from the compressor 11. Due to this arrangement, the third part 53 of the first refrigerant pipe 50 separates from the compressor 11 and/or the first accumulator 41 and draws near the right-side panel 84.

(3-3) Soundproof Materials

The first soundproof material 61 according to one or more embodiments and the second soundproof material 62 according to one or more embodiments shall be described in detail using FIG. 7.

The compressor 11, the first accumulator 41, and the second accumulator 42 are wrapped in two layers by the first soundproof material 61 and the second soundproof material 62.

The first soundproof material 61 encloses the compressor 11 and the first accumulator 41. The second soundproof material 62 is wrapped so as to enclose the first soundproof material 61 wrapped around the compressor 11 and the first accumulator 41, and also enclose the second accumulator 42.

As described above, the space between the compressor 11 and/or first accumulator 41 and the right-side panel 84 grows larger as the compressor 11 or other components increase in size (see FIG. 7). The connection port of the gas-side shut-off valve 30 is slightly separated from the right-side panel 84.

However, according to one or more embodiments shown in FIG. 4, the third part 53 of the first refrigerant pipe 50, which vertically extends between the compressor 11 and/or first accumulator 41 and the right-side panel 84, remains near the right-side panel 84 by employing a configuration for the first refrigerant pipe 50 in which the second part 52 heads toward the right-side panel 84 due to the first curved part 51R.

Therefore, a gap of some size is ensured between the first accumulator 41 and the right-side panel 84 as shown in FIG. 7, and the work of wrapping the first soundproof material 61 and the second soundproof material 62 can be performed using this gap. Specifically, workability during manufacture or maintenance is ensured with the outdoor unit 10.

(4) Characteristics of Outdoor Unit of Air Conditioning Apparatus

Conventionally, outdoor units of air conditioning apparatuses have needed to be of small size.

When the casing decreases in size or when the compressor housed therein increases in size, the gap between the compressor and the refrigerant pipe becomes smaller. In such cases, for example, when the soundproof material is to be wrapped around the compressor, the work involved therewith is more difficult to perform.

In the outdoor unit 10 of the air conditioning apparatus 100 according to one or more embodiments, the space around the compressor 11 and/or the first accumulator 41 is smaller due to factors such as the placement of the gas-side shut-off valve 30, as described above (see FIG. 7).

Figure 3:
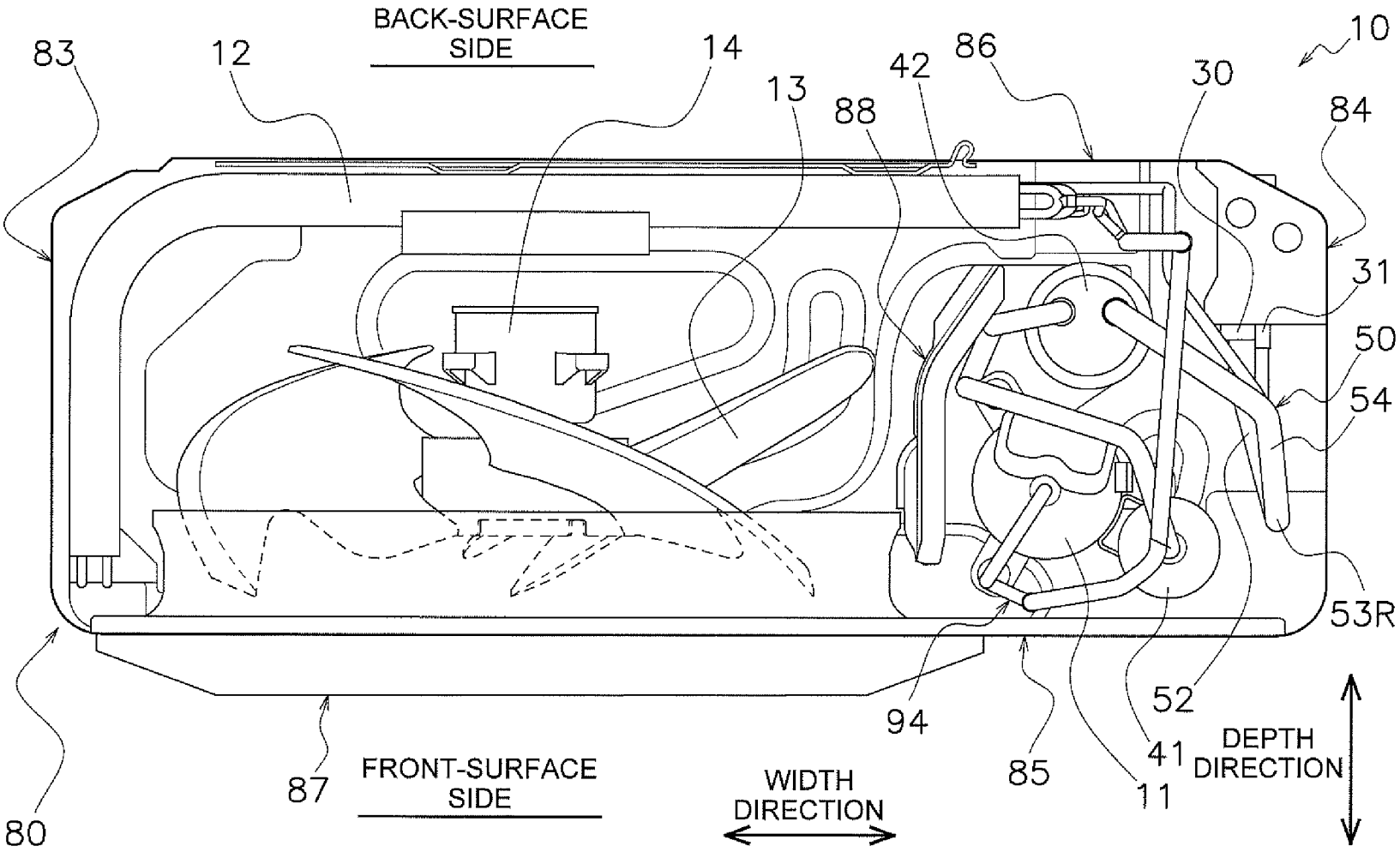
FIG. 3 is a plan view of the heat source unit according to one or more embodiments.

However, in the outdoor unit 10, the first refrigerant pipe 50 connecting the gas-side shut-off valve 30 and the second accumulator 42 together is bent, and the third part 53, which extends upward between the first accumulator 41 and the right-side panel 84, draws nearer to the right-side panel 84 in a front view than the first part 51, which extends toward the front surface from the gas-side shut-off valve 30 (see FIGS. 3 and 4).

Workability is thereby ensured when performing the work of wrapping the first soundproof material 61 and the second soundproof material 62 around the compressor 11 and/or the first accumulator 41, as shown in FIG. 7. Specifically, workability during manufacture or maintenance is satisfactory in the outdoor unit 10.

In the outdoor unit 10, it is also possible to wrap soundproof materials in multiple layers because space around the compressor 11 and/or the first accumulator 41 is ensured.

Although the disclosure has been made with respect to only a limited number of embodiments, those skilled in the art, having benefit of this disclosure, will appreciate that various other embodiments may be devised without departing from the scope of the present invention. Accordingly, the scope of the invention should only be limited by the attached claims.

REFERENCE SIGNS LIST

10 Outdoor unit (heat source unit for refrigeration apparatus)
11 Compressor
12 Outdoor heat exchanger
13 Outdoor fan
30 Gas-side shut-off valve
41 First accumulator
50 First refrigerant pipe
51 First part
51R First curved part
52 Second part
52R Second curved part
53 Third part
53R Third curved part
54 Fourth part
61 First soundproof material
62 Second soundproof material
80 Casing
84 Right-side panel (side panel)
88 Partitioning panel
90 Refrigerant circuit
100 Air conditioning apparatus (refrigeration apparatus)
S1 First space
S2 Second space

CITATION LIST

Patent Literature

[Patent Literature 1] Unexamined Utility Model Publication No. 2-70136

The invention claimed is:

1. A heat source unit for a refrigeration apparatus, comprising:

a refrigerant circuit comprising a shut-off valve, a compressor, a heat exchanger, and a first refrigerant pipe positioned between the shut-off valve and the compressor;

a fan that sends air to the heat exchanger;

a casing that comprises a side panel and that accommodates the refrigerant circuit and the fan; and a partitioning panel that partitions an internal space of the casing into a first space on a side panel side where the compressor is disposed, and a second space where the fan is disposed, wherein the fan blows the air that has passed through the heat exchanger out to a front-surface side of the casing, the side panel extends along a longitudinal direction that is orthogonal to the front-surface side of the casing;

the compressor, the shut-off valve, and the side panel are disposed in order as the compressor, the shut-off valve, and the side panel as seen in a front view, and the first refrigerant pipe comprises:

a first pipe portion extending along the side panel;

a first curved pipe portion extending from an end of the first pipe portion and curving so as to head to the side panel side; and a second pipe portion extending toward the side panel from an end on a side opposite from the first pipe portion side of the first curved pipe portion.

2. The heat source unit for the refrigeration apparatus according to claim 1, wherein the first refrigerant pipe further comprises:

a second curved pipe portion extending from an end of the second pipe portion that is on a side opposite from the first curved pipe portion; and a third pipe portion extending so as to not draw near the side panel from an end on a side of the second curved pipe portion that is on a side opposite from the second pipe portion.

3. The heat source unit for the refrigeration apparatus according to claim 2, wherein the third pipe portion extends along the side panel, upward from the end of the second curved pipe portion.

4. The heat source unit for the refrigeration apparatus according to claim 2, further comprising:

a soundproof material placed around the compressor, wherein part of the soundproof material is disposed between the compressor and the third pipe portion.

5. The heat source unit for the refrigeration apparatus according to claim 2, wherein the first refrigerant pipe further comprises:

a third curved pipe portion extending from an end of the third pipe portion that is on a side opposite from the second curved pipe portion; and a fourth pipe portion extending from an end of the third curved pipe portion that is on a side opposite from the third pipe portion, so as to separate from the side panel.

6. A heat source unit for a refrigeration apparatus, comprising:

a refrigerant circuit comprising a shut-off valve, a compressor, a heat exchanger, and a first refrigerant pipe positioned between the shut-off valve and the compressor;

a fan that sends air to the heat exchanger;

a casing that comprises a side panel and that accommodates the refrigerant circuit and the fan; and a partitioning panel that partitions an internal space of the casing into a first space on a side panel side where the compressor is disposed, and a second space where the fan is disposed, wherein the fan blows the air that has passed through the heat exchanger out to a front-surface side of the casing, the compressor, the shut-off valve, and the side panel are disposed in order as the compressor, the shut-off valve, and the side panel as seen in a front view, the first refrigerant pipe comprises:

a first pipe portion extending along the side panel;

a first curved pipe portion extending from an end of the first pipe portion and curving so as to head to the side panel side; and a second pipe portion extending toward the side panel from an end on a side opposite from the first pipe portion side of the first curved pipe portion, and the first pipe portion extends from the shut-off valve, in a longitudinal direction along the side panel.

7. The heat source unit for the refrigeration apparatus according to claim 1, wherein the refrigerant circuit further comprises a first refrigerant container positioned between the compressor and the first refrigerant pipe, and the compressor, the first refrigerant container, the shut-off valve, and the side panel are disposed in order as the compressor, the first refrigerant container, the shut-off valve, and the side panel as seen in a front view.

* * * * *